United States Patent [19]

Witte et al.

[11] 4,297,227

[45] Oct. 27, 1981

[54] METHOD FOR CONTINUOUS GREASE MANUFACTURE

[75] Inventors: Arnold C. Witte, Port Neches; Richard L. Coleman, Port Arthur, both of Tex.

[73] Assignee: Texaco Inc., White Plains, N.Y.

[21] Appl. No.: 113,162

[22] Filed: Jan. 18, 1980

Related U.S. Application Data

[63] Continuation-in-part of Ser. No. 16,597, Mar. 2, 1979, abandoned.

[51] Int. Cl.[3] ..... C10M 5/16; C10M 5/14; C10M 5/02; C10M 7/22

[52] U.S. Cl. ..... 252/18; 252/25

[58] Field of Search ..... 252/18, 25

[56] References Cited

U.S. PATENT DOCUMENTS

| | | | |
|---|---|---|---|
| 3,242,083 | 3/1966 | Crookshank et al. | 252/39 |
| 3,475,335 | 10/1969 | Greene et al. | 252/39 |
| 3,475,337 | 10/1969 | Green et al. | 252/41 |
| 3,488,721 | 1/1970 | Frye | 252/18 |
| 3,537,995 | 11/1970 | Wright | 252/18 |
| 4,100,080 | 7/1978 | Adams | 252/18 |

*Primary Examiner*—Delbert E. Gantz
*Assistant Examiner*—Irving Vaughn
*Attorney, Agent, or Firm*—Carl G. Ries; Robert A. Kulason; Elizabeth M. Manning

[57] ABSTRACT

A continuous process for manufacture of soap thickened grease compositions where a saponifiable material and a metal base are continuously introduced at an elevated temperature into a saponification zone maintained at superatmospheric pressure and saponified under turbulent conditions, wherein the saponified product is mixed with an aqueous solution of oil-insoluble additive materials at a superatmospheric pressure sufficient for maintaining all water in the liquid phase, wherein the saponified material-additive mixture is heated to an elevated temperature of at least 350° F., wherein the heated saponified material additive mixture is flowed into a dehydration zone maintained at a reduced pressure for flash vaporizing substantially all water therefrom and producing a dehydrated saponified material having oil-insoluble additive evenly dispersed therethrough as particles not exceeding about 10 microns, and wherein the dehydrated saponified material is blended with lubricating oil to produce a grease product.

8 Claims, 1 Drawing Figure

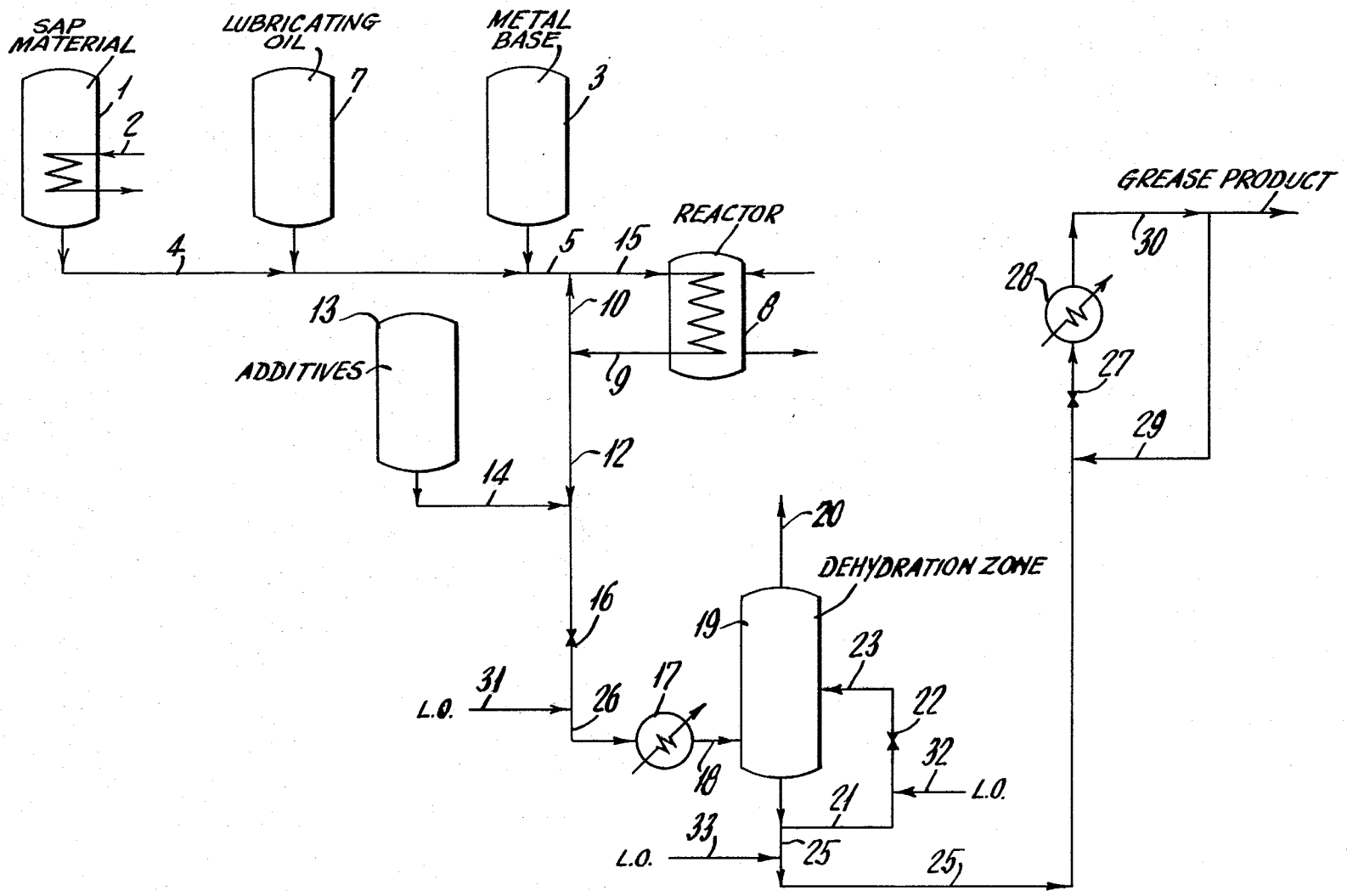
GREASE PRODUCT
30
29
27
28
DEHYDRATION ZONE
L.O.
22
32
25
23
21
20
25
19
18
17
33
L.O.
REACTOR
8
15
10
9
12
16
26
3
METAL BASE
5
14
31
L.O.
13
ADDITIVES
7
LUBRICATING OIL
4
1
2
SAP MATERIAL

METHOD FOR CONTINUOUS GREASE MANUFACTURE

This application is a continuation in part application of application Ser. No. 016,597, filed Mar. 2, 1979, now abandoned.

BACKGROUND OF THE INVENTION

The present invention relates to a continuous process for manufacturing soap thickened grease compositions containing water soluble additives, e.g. additives useful for imparting to such grease compositions improved properties such as corrosion resistance and/or extreme pressure wear properties.

Continuous processes for manufacturing soap thickened grease compositions are known in the prior art. For example, U.S. Pat. No. 3,475,335, issued Oct. 28, 1969 to John H. Greene, et al, discloses a process wherein a saponifiable material, (fatty acids, etc.) is mixed with an inorganic base (lithium hydroxide, etc.), in a tubular reactor, in the presence of water, at saponification conditions of temperature and pressure for forming a soap, wherein the reaction mixture from said tubular reactor is dehydrated, in a dehydrator vessel, at reduced pressure; wherein soap containing material from said dehydrator, is recirculated through a shear valve for improving the rate of dehydration and for conditioning the soap; and wherein a continuous stream of dehydrated soap containing material withdrawn from said dehydrator is intimately mixed with oil to form a grease product. Additives, particularly water soluble compounds useful as corrosion inhibitors and/or as additives for improving extreme pressure wear properties, are preferably added, as non-aqueous mixtures, to the dehydrated soap-containing material immediately prior to mixing oil therewith.

U.S. Pat. No. 3,488,721, issued Jan. 6, 1970 to Richard L. Frye, discloses a method of preparing a water-free oil-additive slurry for addition to a soap thickened grease.

In such methods of the prior art, as described above, the preparation of an oil-additive slurry which is sufficiently dispersible in a grease product is difficult, and requires additional process steps. Considering the process of U.S. Pat. No. 3,488,721, a water solution of an oil-insoluble additive is mixed with an amount of oil to form an emulsion. This emulsion is heated under conditions of high shear mixing for driving water therefrom and to yield a slurry of said additive in oil, wherein the additive particle size is sufficiently small (less than 10 microns) for incorporation into a grease product. Difficulties are encountered in preventing agglomeration of additive materials present in the oil slurry into particles sufficiently large to impart a grainy appearance to the grease product.

SUMMARY OF THE INVENTION

Now, according to the method of the present invention, we have discovered an improved method for producing a grease product containing water-soluble additives via a continuous grease manufacturing process.

In a preferred embodiment of the improvement of the present invention, a saponification zone product, comprising soap, is mixed with an aqueous additive solution at pressure sufficient to maintain all water present in the liquid phase, at an elevated temperature, preferably greater than about 350° F., sufficient for vaporizing substantially all water from the mixture upon a substantial pressure reduction, as is described herebelow. The heated saponification product-additive mixture is flowed through a pressure reducing device (valve) into a dehydration zone maintained at a reduced pressure, preferably in the vacuum range, and at an elevated temperature wherein substantially all water present in said mixture is flash vaporized such that the oil-insoluble additive is evenly dispersed throughout the saponification product as small particles not exceeding about 10 microns in size.

According to the process of the present invention, further treatment of the saponification product, such as soap conditioning, incorporation of oil, etc., required for manufacture of a useful grease product may be accomplished by means known in the art of continuous grease processing.

Advantages of the present invention include incorporation of oil-insoluble additives into a soap thickened grease as an aqueous solution under conditions wherein the additive is evenly dispersed therein as small particles of less than 10 microns in size. The necessity of forming a slurry of finely divided oil-insoluble additives in an oil for adding to the grease is eliminated.

These and other advantages of the present invention will be disclosed in the detailed discussion which follows.

BRIEF DESCRIPTION OF THE DRAWINGS

The drawing is a schematic representation of a continuous process for manufacturing soap thickened grease incorporating the improvement of the present invention.

DETAILED DESCRIPTION

In the manufacture of soap thickened grease compositions, water soluble (oil insoluble) compounds are admixed therewith for imparting improved anticorrosive properties and/or improved extreme pressure wear properties to such grease compositions. Examples of such additives employed in grease compositions include sodium nitrite, sodium chromate, sodium molybdate, ammonium nitrate, cadmium acetate, sodium metaborate, sodium sulfide, zinc borate, borac acid, mixtures thereof, etc. Such compounds, being oil insoluble, must be evenly dispersed through a grease composition in order to adequately perform their anticorrosion and/or extreme pressure function. Additionally, the dispersion should comprise additive particles of about 10 microns or less, and preferably particles of 5 microns or less. For the grease to pass visual inspection for smoothness (eg. lack of grainy appearance) the particles of the dispersed water soluble additives should have a size below about 10 microns. In addition, additive particles having a substantial degree of hardness and large particle size can unduly abrade surfaces being lubricated. Thus, it is desirable to provide water soluble additive compounds in a form for incorporation into a grease composition as very small particles below 10 microns in size, and preferably of a size less than 5 microns, for improving grease composition appearance and wear resistance and for reducing abrasion and noise resulting from use of such grease compositions.

The method of the present invention provides an improvement to continuous processes for manufacturing soap thickened greases whereby such water soluble additives, as are described above, may be incorporated into grease compositions in the form of evenly dispersed particles of a size less than about 10 microns, and preferably less than about 5 microns.

Grease compositions within contemplation of the present invention comprise the reaction product of a saponifiable material with a metal base in admixture with oils having lubricating properties. Water soluble additive compounds employed as anticorrosion and/or as extreme pressure agents are dispersed evenly throughout such grease compositions, according to the improved method of the present invention.

Suitable saponifiable materials for use in preparation of these grease compositions comprise higher fatty acids containing from about 12 to 32 carbon atoms per molecule and hydroxy substituted higher fatty acids, their glycerides and other esters and mixtures thereof. Also within contemplation of the present invention are grease compositions prepared using saponifiable materials comprising such higher fatty acid materials in admixture with lower fatty acid materials, such as fatty acid containing from one to about 6 carbon atoms per molecule, their glycerides and other esters. Such lower fatty acid materials may be employed in amounts giving a mole ratio of lower fatty acid to higher fatty acid from below 1:1 to about 20:1, respectively. Also, intermediate molecular weight fatty acid materials may be employed in admixture with the higher fatty acid materials in varying amounts generally within the mole ratio of intermediate to higher fatty acid materials below about 1:1, respectively.

Metal bases employed in saponification of the saponifiable materials may be a hydroxide or other suitable basic reacting compound of any of the metals ordinarily employed as the metal component of soaps employed in manufacture of lubricating greases. Such as, for example, the oxides, hydroxides, or carbonates of sodium, lithium, potassium, calcium, barium, magnesium, zinc, cobalt, maganese, aluminum, lead, etc. The greases most advantageously prepared by the method of this invention are those wherein the soap thickener is an alkali metal or alkaline earth metal soap, or a mixture of two or more soaps of these classes.

The oil employed in greases to be manufactured according to the process of the present invention may be selected from suitable oils having lubricating characteristics, including the conventional mineral lubricating oils, synthetic oils obtained by various refining processes such as cracking and polymerization, and other synthetic oleaginous compounds such as high molecular weight ethers and esters. The dicarboxylic acid esters, such as di-2-ethylhexyl sebacate, di(sec-amyl) sebacate, di-2-ethylhexyl azelate, diisoctyl adipate, etc. comprise a particularly suitable class of synthetic oils and may be employed either as the sole oleaginous component of the grease or in combination with other synthetic oils or mineral oils. Suitable mineral oils for use in these greases are those having viscosities in the range from about 100 to about 8000 seconds, Saybolt Universal at 100° F., which may be blends of low and high viscosity naphthenic or paraffinic oils, or blends of two or more oils of these different types.

In the production of greases from synthetic oils which may hydrolyze under the saponification conditions, the saponification reaction is preferably carried out in the absence of any lubricating oil or in the presence of an oil which is substantially inert under the saponification conditions, such as mineral oil and the synthetic oil added at later stages of the grease making process.

Grease making processes contemplated herein comprise saponification, dehydration, and soap conditioning steps carried out in a continuous manner with recycling of the grease mixture through a shear valve during the soap conditioning step. According to the improvement of the present invention, water soluble additives are added as aqueous liquid solutions to the saponification reaction product, the water of solution is removed during the dehydration step in a manner to produce additive particles of less than 10 micron (preferably less than 5 micron) size dispersed throughout the grease composition. The process also preferably comprises a cooling and finishing step, which may be carried out by addition of lubricating oil at a lower temperature than the grease mixture or by flowing the grease mixture through a cooler following the soap conditioning step.

In carrying out the improved process of this invention, the saponification zone is maintained at an elevated temperature for enhancing the saponification reaction, and at an elevated pressure at least sufficient to maintain water present in the liquid phase, and the dehydration zone is operated at an elevated temperature, but preferably below the melting point of the soap, and under a substantially lower pressure than the saponification zone such that substantially all water present is flashed when the saponification reaction product enters the dehydration zone, such that the water-soluble additive is distributed throughout the saponification product as particles of less than 10 micron, and preferably less than 5 micron size. Any remaining water is removed during recycling of the grease mixture through the conditioning step shear valve; which in effect subjects the grease mixture to a continuous flashing operation by pressure release of the recycle stream through the shear valve. Such recycling, for the soap conditioning step, is preferably carried out at a rapid rate, such that the grease mixture is subjected to multiple passes through the high pressure drop shear valve during the residence time of the grease mixture within the dehydration zone.

Cooling of the grease mixture after the conditioning step is preferably carried out with the addition of lubricating oil at a substantially lower temperature than the grease mixture, and very advantageously in some cases with recycling of the grease mixture through a cooler. The process is also carried out advantageously in some cases with additional conditioning of the soap by recycling the grease mixture through a second shearing means during or after cooling.

Greases of excellent quality having water soluble additives evenly distributed therethrough are obtained from the improved process described above in good yields and in reduced manufacturing times as compared with prior art processes.

The invention will be better understood from the following description in conjunction with the accompanying drawing. The drawing is a schematic representation of a continuous grease plant for carrying out the process of the present invention. For the sake of clarity many elements, such as valves, piping, instrumentation, pumps, etc., commonly employed in such process plants have been omitted from the drawing. As the drawing is representational of one embodiment of the present invention, it is not intended as a limitation upon the present invention which is set-out in the appended claims.

In the drawing, a saponifiable material maintained at a temperature above the melting point in vessel 1 by heat supplied from heating means 2. Vessel 7 contains lubricating oil. Vessel 3 contains an aqueous solution or oil slurry of metal base.

Saponifiable material from vessel 1 flows at a controlled rate via line 4 into line 5. Lubricating oil flows from vessel 7 at a controlled rate via line 11 into line 5. Metal base from vessel 3 flows at controlled rate via line 6 into line 5. From line 5, the saponifiable material, lubricating oil, and metal base flow into the inlet 15 of saponification zone of tubular reactor 8. When the saponification reaction is carried out employing a slurry of metal base in oil, it is generally desirable to introduce a small amount of water or steam into saponification zone 8 for promoting the saponification reaction. The mixture in saponification zone 8 is maintained under superatmospheric pressure sufficient to maintain water present in the liquid phase, and at an elevated temperature sufficient to obtain a rapid reaction between the metal base and the saponifiable material. Suitable reaction conditions include pressures in the range from about 10 to about 300 psig, and temperatures from about 180° F. up to above the melting point of the soap formed in the reaction. Preferably, pressures are selected in the range from about 50 to about 200 psig and temperatures are selected in the range of from about 200° F. to about 350° F.

The reactant stream is passed through saponification zone 8 at a velocity which is preferably sufficient to maintain turbulent flow within the tubular reactor. Preferably, reactant mixture flow velocity is sufficient for producing highly turbulent flow, as exemplified by Reynolds numbers in the range of about 4000 to about 100,000 $N_{RE}$. Flow rates required for obtaining the degree of turbulence are generally within the range of from about 0.6 to about 12.0 cubic feet per minute of reaction mixture per square inch of reactor cross section. For obtaining such desired high flow rates of reactant mixture through saponification zone 8, reactor effluent from saponification zone outlet 9 may be recycled via line 10 to saponification zone inlet 15. In this manner, a high flow rate of reaction mixture through saponification zone 8 may be maintained independent of charge rate of reactants to the process, and turbulent flow through saponification zone 8 can be maintained even with a saponification reaction mixture requiring a relatively long residence time for substantially complete reaction or where a charge rate below that required for turbulent flow is required by other conditions of the process. The recycle rate employed is ordinarily in a recycle to charge ratio from about 10:1 to about 100:1, although somewhat lower or higher recycle ratios may sometimes be employed, such as ratios as low as 1:1 and as high as 200:1.

In the drawing, a saponification reaction product stream is withdrawn from line 9 via line 12 at about the elevated temperature and superatmospheric pressure of saponification reaction in reaction zone 8. An aqueous solution of water-soluble additives, contained in vessel 13 is added via line 14 to the saponification reaction product stream in line 12. According to the present invention, water-soluble additives which may be introduced into the grease mixture in this manner include additives which contribute anticorrosive, extreme pressure wear, and other desirable properties to the finished grease. As stated hereinabove, such additives include such inorganic compounds as sodium nitrite, cadmium acetate, sodium metaborate, sodium sulfide, zinc borate, boric acid, mixtures thereof, etc. Such additive compounds are relatively water soluble such that fairly concentrated solutions may be prepared. Preferably, such additive compounds, for use in the present invention will comprise about 10 to 40 weight percent of said aqueous solutions, It is desirable to minimize the water injected into the grease with the additives, as such water must be removed later in the process. Therefore, aqueous solutions of additives are preferably fairly concentrated. At lower concentrations, evaporation of the water of solution requires an excessive amount of energy. At higher concentrations the additives may precipitate from the aqueous solution before addition to the grease mixture. Generally, sufficient aqueous solution will be admitted to line 12 from line 14 so that the water soluble additives wil be present in the grease in amounts ranging from about 0.5 to about 2 wt. percent of the grease product.

In the drawing, in line 12 according to the present invention saponification reaction product and aqueous additive solution are combined under conditions of superatmospheric pressure such that all water present is maintained in the liquid phase. Temperature of the combined mixture in line 12 is maintained, preferably in the range of about 250° F. to about 350° F., sufficiently high such that all water present in the combined mixture will vaporize upon reduction of the superatmospheric pressure, as will be described hereinbelow. A temperature of about 350° F. has been found sufficient to provide the necessary amount of heat to such combined mixtures. The temperature of the combined mixture in line 12 should not exceed the melting point of the soap component of the grease.

In the drawing, according to the present invention, the hot combined mixture of saponification product and aqueous additive solution passes through pressure reducing valve 16 into heating means 17. Pressure drop across valve 16 is sufficient to effect flash vaporization of substantially all water present in the combined mixture. Flash vaporization of the water in the combined mixture is thus effected. Additional heat is imparted to the combined mixture in heating means 17 to restore or increase the temperature of the combined mixture to at least about 250° F., and preferably about 350° F., and to prevent condensation of water. From heating means 17 the combined mixture and water vapor flow via line 18 into dehydration zone 19.

Dehydration zone 19 comprises a vertical cylindrical vessel having a volume sufficient to receive said combined mixture and water vapor and provide a residence time therein for the combined mixture of from about 1 minute to about 20 minutes. The vessel may be equipped with a jacket for providing additional heating or cooling, as the process may require. Dehydration zone 19 is maintained at a pressure up to about atmospheric, and preferably in the vacuum range, under conditions wherein substantially all the liquid water present in the combined mixture flash vaporizes upon passing through valve 16, such that water soluble additive present is distributed throughout the saponification product as small particles of about 10 microns or less, and preferably less than 5 microns in size. Vaporized water is withdrawn from dehydration zone 17 via vent line 20.

In the drawing, the additive containing saponification production in dehydration zone 19 is maintained at a temperature of at least 225° F., and ordinarily at least about 250° F., but below the melting point of the soap present in the above, preferably a pressure of about 5 to 25 inches of mercury.

In the drawing, the grease mixture is recycled continuously from the bottom of dehydration zone 19 through line 21, shear valve 22, and line 23 into an upper level of dehydration zone 19. Shear valve 22 is suitably a gate valve, set to provide a pressure drop of about 10–200 pounds per square inch, and preferably about 25–125 pounds per square inch. Recycling of the grease mixture is preferably carried out at a rapid rate, such that the turn over rate in dehydration zone 19 is at least equivalent to about the average volume of grease therein per minute, and sufficient to provide at least about 5 batch turnovers, and advantageously at least 10 batch turnovers, during the average residence time of the grease mixture within zone 19. This recycling of the grease mixture conditions the soap therein and serves to obtain essentially complete dehydration of the grease mixture. Preferably, the recycle rate and average residence time in zone 19 are sufficient to provide a soap conditioning period of at least about 5 minutes. By such conditioning, the soap of the grease mixture is reduced to a consistency which contributes to the desired consistency for the product grease.

In the drawing, lubricating oil may be added to the grease mixture at various stages in the process in order to obtain a grease product of desired soap concentration. Lubricating oil may pass into the combined mixture in line 26 via line 31, preferably to provide at least about 10 percent lubricating oil in the grease mixture entering dehydration zone 19. Such oil, when preheated may be used as a means to heat the grease mixture in order to increase flash vaporization of water in zone 19.

Lubricating oil may also be added, via line 32 into line 21 wherein the grease mixture is undergoing conditioning. This oil addition may have special advantage in aiding recycle when a heavy grease mixture is being circulated, and also as a means of increasing the rate of dehydration by increasing temperature of the recycle stream. Additional oil is preferably added as required to provide a grease mixture in zone 19 containing at least about 25 weight percent lubricating oil, and preferably at least about 40 percent by weight of lubricating oil. In addition to the function of the lubricating oil addition to the grease mixture in zone 19 as a means for obtaining to the desired concentration, the oil addition may be employed as a means of either heating or cooling the grease mixture to a temperature within the desired soap conditioning range.

In the drawing, a stream of essentially dehydrated grease mixture is continuously withdrawn from the recycle stream in line 21 via line 25. As required, additional lubricating oil may be added to this dehydrated grease mixture via line 33. It is ordinarily preferable to add this oil at a temperature substantially lower than that of the grease mixture for the cooling it provides. The additional oil added to the grease mixture in line 25 may amount to as much as 90 weight percent of the total oil in the finished grease. It is ordinarily preferable to carry out the grease manufacture with about 20–80 percent of the total oil contained in the grease product added at this point at a temperature at least about 100° F. below the temperature of the grease mixture in line 25.

In the drawing, the grease mixture from line 25 passes through shear valve 27, which may be operated with a substantial pressure drop. In cases where additional cooling is desirable, the grease may then be passed through cooler 28, and the grease mixture may be recycled via line 29 for obtaining multiple passes through shear valve 27. From line 29 a stream of grease product is withdrawn via line 30 for packaging, not shown.

The above description discloses an improved method wherein aqueous solutions of water soluble additives are incorporated with saponification product in a continuous grease manufacturing process to form a combined mixture, and wherein substantially all water is flash vaporized from the combined mixture, such that additives are evenly dispersed throughout the grease mixture in particle sizes of about 10 microns or less.

In view of the above disclosure, many obvious variations and modifications of the above process will occur to those skilled in the art. It is intended that all such obvious variations and modifications be considered as included herein, and the only limitations intended for the present invention are those incorporated within the appended claims.

We claim:

1. In a continuous grease manufacturing process wherein a saponifiable material is reacted with an aqueous solution of a metal base in a saponification zone at saponification conditions of elevated temperature and superatmospheric pressure to produce a soap containing saponification reaction product, wherein said saponification reaction product is passed through a pressure reducing means to effect pressure reduction and to flash vaporize substantially all the water present in said saponification reaction product and the said flashed vaporized water as well as any remaining water is removed from said saponification reaction product by flash vaporization in a dehydration zone to produce a dehydrated saponification product, and wherein said dehydrated saponification product in said dehydration zone is recycled through a shear valve for conditioning said soap contained therein, and wherein lubricating oil is added to said recycled dehydrated saponification product for producing a grease product; the improvement which comprises:

(a) admixing an aqueous solution of at least one water soluble additive compound, which improves properties of said grease product, with said saponification reaction product under conditions of superatmospheric pressure sufficient to maintain water present in the liquid phase and at an elevated temperature sufficiently high for flash vaporizing substantially all water present in the resulting admixture upon subsequent substantial pressure reduction, thereby forming a hot combined mixture of saponification reaction product and aqueous additive solution; and (b) passing said formed hot combined mixture through a pressure reducing means that is maintained at a pressure not greater than about atmospheric and sufficient for flash vaporizing substantially all water present in said hot formed mixture and passing the resulting substantially dehydrated mixture and vaporized water into said dehydration zone to flash vaporize any remaining water in said mixture and for producing additive particles of a size not greater than about 10 microns distributed within said dehydrated mixture.

2. The method of claim 1 wherein the combined mixture is heated to a temperature in the range of about 250° to about 350° F., and wherein said grease mixture in said dehydration zone is maintained at a temperature of at least about 225° F. and below the melting point of said soap present in said grease mixture.

3. The method of claim 2 wherein pressure within said dehydration zone is maintained within the range of about 5 to 25 inches of mercury.

4. The method of claim 3 wherein said grease mixture in said dehydration zone is recycled through a shear valve under temperature conditions sufficient for evaporating essentially all remaining water from said grease mixture.

5. The method of claim 4 wherein hot oil is added to said combined mixture prior to pressure reduction for increasing the temperature.

6. The method of claim 4 wherein combined mixture and water vapor from said pressure reducing means is heated to a temperature in the range of about 250°–350° F. prior to entry into said dehydration zone.

7. The method of claim 6 wherein said water soluble additives comprise anticorrosion additives and extreme pressure wear additives.

8. The method of claim 7 wherein said water soluble additives are selected from the group consisting of sodium nitrite, sodium chromate, sodium molybdate, ammonium nitrate, cadmium acetate, sodium metaborate, sodium sulfide, zinc borate, boric acid, and mixtures thereof.

* * * * *